United States Patent [19]

Bresie et al.

[11] Patent Number: 4,479,546

[45] Date of Patent: Oct. 30, 1984

[54] METHOD AND APPARATUS FOR PRODUCING NATURAL GAS FROM TIGHT FORMATIONS

[76] Inventors: Don A. Bresie; Jack M. Burns; Donald W. Fowler, all of 5407 N. IH 35 Suite 304, Austin, Tex. 78723

[21] Appl. No.: 461,991

[22] Filed: Jan. 28, 1983

[51] Int. Cl.[3] ..... E21B 43/12; E21B 43/34

[52] U.S. Cl. ..... 166/369; 166/79; 166/86; 166/267; 166/379

[58] Field of Search ..... 166/369, 379, 267, 79, 166/266, 86, 53, 67; 48/190, 191; 137/351; 405/53

[56] References Cited

U.S. PATENT DOCUMENTS

| | | | |
|---|---|---|---|
| 1,790,450 | 1/1931 | Torrance | 166/267 |
| 2,412,765 | 12/1946 | Buddrus et al. | 166/266 |
| 2,828,818 | 4/1958 | Wright | 166/267 X |
| 3,175,614 | 3/1965 | Wyllie | 166/250 |
| 3,232,725 | 2/1966 | Second et al. | 405/53 X |
| 3,300,983 | 1/1967 | Dougherty et al. | 166/68 |
| 3,493,050 | 2/1970 | Kelley et al. | 166/267 |
| 3,580,336 | 5/1971 | Meldau | 166/267 |
| 3,863,714 | 2/1975 | Watson, Jr. | 166/369 X |
| 3,882,937 | 5/1975 | Robinson | 166/267 |
| 4,139,019 | 2/1979 | Bresie et al. | 48/190 X |
| 4,150,721 | 4/1979 | Norwood | 166/53 |
| 4,213,476 | 7/1980 | Bresie et al. | 166/267 X |
| 4,226,284 | 10/1980 | Evans | 166/53 X |

*Primary Examiner*—Stephen J. Novosad

*Attorney, Agent, or Firm*—Francis B. Francois; Francis D. Thomas, Jr.

[57] ABSTRACT

Natural gas wells in a tight formation area are drilled and completed with piping, the piping being capped with a Christmas tree. The piping is then utilized as a reservoir to collect natural gas from the tight formation over a prolonged time period. Mobile pressure vessel units are employed periodically to recover the collected natural gas, on a schedule designed for maximum economic efficiency. In the preferred embodiment, the reservoir is formed between the inner production tubing and the outer casing tubing, and conduits are connected to direct the natural gas from the production tubing into the reservoir. Liquid/gas separators and dehydrator units are employed on wells as necessary, so that the natural gas stored in the reservoir is ready for transport.

18 Claims, 3 Drawing Figures

METHOD AND APPARATUS FOR PRODUCING NATURAL GAS FROM TIGHT FORMATIONS

TECHNICAL FIELD OF THE INVENTION

This invention relates generally to methods and apparatus for producing natural gas from gas wells. More particularly, it relates to a novel method and apparatus for producing natural gas from so-called tight formation areas, without the necessity of utilizing expensive bottom-of-the-well techniques to increase the yield from the formation, or the need to build expensive pipeline networks.

BACKGROUND OF THE INVENTION

Over the past several years, natural gas wells have been drilled in geographic areas where the gas producing geological formation has a very low permeability. These geological structures release natural gas very slowly, and are commonly called tight formations. Typically, such tight formations are deep in the earth, and hence drilling a well is expensive. Because the natural gas flows so slowly, the normal production techniques utilizing a pipeline network are not feasible for tight formation gas wells; the amount of natural gas that can be recovered over a reasonable period of time is insufficient to justify the capital and operating expenditures required for production.

The natural gas reserves represented by tight formation areas are very large, however, and thus these wells are valuable and important. Basins containing tight formations stretch through Louisana and Texas, and north through the northern Great Plains into Canada. In the United States alone, the reserves of natural gas in such tight formation areas are believed to be more than 400 Tcf. Beyond this, similar geological areas can be found world-wide.

Because of the huge volume of natural gas available in tight formation areas and the continuing need for energy, considerable research has been and is being conducted seeking ways to increase the rate of production from tight formation wells. One technique has been to employ massive hydraulic fracturing, which has proven to be effective in some instances. This technique is expensive, however, and adequate results are not assured. In the late 1960's and early 1970's nuclear devices were also utilized in efforts to increase natural gas flow, but did not produce good results. Other similar techniques are currently under development.

All of the techniques thus far proposed to increase the yield from tight formation areas share the characteristic of being expensive to implement, with the chances for success problematical. The typical gas well in a tight formation area is deep and thus is difficult to work with, and in addition the formations producing the natural gas may be several in number and vertically separated. Despite the large investment already made in attempting to economically produce tight formation gas wells through techniques designed to increase the release of natural gas from the formation, progress has been slow and results have been less than promising. Because of this the vast natural gas reserves available in these fields remains largely untapped.

There is thus a serious need for a new methods and apparatus for producing tight formation gas wells in an economical manner, avoiding the difficulties thus far encountered and making it practical to utilize the natural gas from these wells to meet the energy requirements of the world. The present invention is intended to satisfy that need.

SUMMARY OF THE INVENTION

The present invention moves in an entirely different direction from past efforts aimed at obtaining economical natural gas production from tight formation gas wells. Rather than utilizing experimental, expensive and thus far largely unproductive bottom-of-the-well technology, the present invention is concentrated on the surface of the earth and is designed to optimize the recovery of whatever natural gas is released over time into the well bore from the tight formation area. The invention avoids the need to build pipelines and the making of other large capital investments, and instead utilizes some selected elements from a known technology in conjunction with a new method and arrangement of apparatus to recover natural gas economically from tight formation gas wells and provide it to the market. Further, the present invention is especially adapted for use in remote geographic areas where many tight formation gas wells are located, and where conventional pipelines are either presently absent or will never be economically feasible.

In the present invention, each gas well in a tight formation area is completed with piping, and is capped. The piping is then utilized as a reservoir, into which natural gas from the tight formation flows over a lapse of time and accumulates. According to the invention, the rate of natural gas flow from the tight formation into the well piping reservoir, the holding capacity of the reservoir, and the time lapse required to accumulate a batch volume or quantity of natural gas having a volume and pressure chosen to assure optimum well production is first calculated for each well involved. From this information the number of mobile pressure vessel units required to transport the optimum batch volumes or quantities of natural gas is calculated, and then a collection schedule is established for collecting the natural gas in the mobile pressure vessel units.

The mobile pressure vessel units employed are like those disclosed in our prior U.S. Pat. Nos. 4,139,019 and 4,213,476. Typically, such a unit will consist of several pressure vessels mounted on a semi-trailer truck for operation on land, but the utilization of watercraft is also contemplated in the invention. The pressure vessels are made of high-strength steel, and are mounted in clusters served by a manifold arrangement. The pressure vessels are designed to carry natural gas under pressure in the 2,000 to 3,000 psi range, and in the present invention the need for compression equipment is avoided at the well head by working only with those gas wells that can over time produce quantities of natural gas at pressures in the desired operating range. Fortunately, it has been found that the generation of pressures in the 2,000 to 3,000 psi range and higher is not uncommon in tight formation gas wells.

A rule of thumb indicator for the pressure in a natural gas well is that each foot of depth will result in a pressure of about 0.4 psi. This means that a 6,000 foot deep tight formation gas well can normally be expected to produce a gas pressure of about 2,400 psi, and an 8,000 foot deep well a 3,200 psi pressure. Since tight formation wells are known to depths in the range of 10,000 to 12,000 feet, where pressures of about 4,000 psi, respectively, can be expected, it is seen that pressure in the 2,000 to 3,000 psi operating range are readily available in tight formation wells. Thus, the watching of well pressure to pressure vessels capable of safely transporting natural gas at pressures in the 2,000 to 3,000 psi range is not difficult.

One reason for transporting natural gas at pressures in the 2,000 to 3,000 psi range has to do with a phenomona known as supercompressability. An ideal gas has a density approximately proportionate to the pressure to which the gas is compressed. But natural gas is not an ideal gas, and does not balance as such. The density of natural gas can reach two times or more that of an ideal gas, a characteristic known as supercompressability and which allows the amount of natural gas carried at certain pressures to be much greater than for an ideal gas at the same pressure. The optimum pressure for natural gas, where supercompressability is maximized, is usually about 2,200 psi, give or take a few hundred psi depending on the chemical compensation of the gas. Thus, the preferred transport pressure is in the 2,000 to 3,000 psi range, when it is desired to take advantage of the supercompressability characteristic of natural gas.

By transporting the natural gas at high pressures under ambient conditions as described in the two earlier patents cited above, the need for expensive refrigeration and related equipment at the well head is avoided. The invention does contemplate utilizing commonly available liquid-gas separator and gas dehydration units at the well head, when the make-up of the raw natural gas accumulated in the wall piping is such that the use of the equipment is desirable or necessary to assure safe transport of the natural gas.

Once the collection schedule is established, the mobile pressure vessel units are moved from well to well in accordance with it. In some instances, a well may produce two or three commercial-size loads per day, and in others a week or more may be required before emptying of the well reservoir is appropriate. A principal advantage of the invention is that the time required for the tight formation to release a commercial quantity of natural gas at an appropriate transport pressure can be easily accommodated, for no idle equipment such as a pipeline is present during the required time lapse.

The mobile pressure vessel units make periodic visits to the selected wells chosen for the project, in accordance with the established schedule. In some instances a single mobile pressure vessel unit may be adequate to service a given well, while other wells might require additional units. In other instances, the same pressure vessel unit might be able to service several wells, before it is filled. In any event, once a mobile pressure vessel unit has been sufficiently filled it is moved to an off-loading facility, which can be a pipeline or similar installation, where the natural gas is substantially emptied from the unit. The unit is then ready for another collection trip. By repeatedly moving the mobile pressure vessel unit(s) between the selected gas well(s) and the off-loading facility in accordance with the collection schedule, continuous production of natural gas is obtained from the gas well field.

While the present method and apparatus can be utilized with essentially any natural gas field, it is especially adapted to meet the problems found in tight formation fields. The risky, expensive bottom-of-the-well techniques currently utilized can be avoided entirely in many instances, and instead natural gas production can be obtained economically and at an early date.

Turning to the apparatus for the invention, in the preferred embodiment the principal storage reservoir at the well site is formed between the inner production tubing and an outer casing tubing. The well is completed after drilling by placing the casing and cementing around it, with the production tubing being placed generally concentrically within the casing tubing. A conventional plug is then utilized near the bottom of the hole to seal the lower end of the annular reservoir, and a Christmas tree of an acceptable design is utilized to cap the upper end of the annular reservoir and the production tubing.

In the preferred embodiment, conduits are provided that direct natural gas from the production tubing into the annular reservoir. When the natural gas coming from the tight formation is under very high pressure, a pressure regulator is utilized in the conduit system. Further, when required, a liquid-gas separator and a dehydrator unit are placed into the conduit system before the annular reservoir, so that the natural gas entering the reservoir is treated and ready for transport. After the desired volume and pressure of natural gas have accumulated in the annular reservoir, it is emptied into a mobile pressure vessel unit, after which build-up of natural gas from the tight formation begins again.

The invention also contemplates that in some instances the production tubing and the annular reservoir can both be utilized to accumulate the natural gas, and other arrangements are also possible. In the simpliest embodiment of the invention, the production tubing alone is utilized to accumulate the natural gas and is periodically connected directly to a mobile pressure vessel unit; this concept is normally desirable, however, only when pressures are within a desired range, and when the natural gas is relatively pure and moisture free.

It is a principal object of the present invention to provide a method and apparatus for use in easily and efficiently producing natural gas from gas wells located in a tight formation area.

Another object of the invention is to provide a method and apparatus for producing natural gas from a field of gas wells without the need to build pipelines in the field, or the need to provide expensive well-head equipment for the wells.

Yet another object of the invention is to provide a method and apparatus for producing natural gas wherein natural gas storage is achieved within the well piping, and the construction of storage facilities at the well head is avoided.

It is also an important object of the invention to provide a new and different tight formation gas well production system, but a system which is designed to make use of known technology, and, in particular, known techniques and equipment for transporting natural gas under high pressure in mobile pressure vessel units.

A further object is to provide a storage arrangement at the well site that utilizes the production and casing tubings of the well, and which provides an annular reservoir for storing treated natural gas.

Still another object of the invention is to provide a method and apparatus for producing natural gas wells that can essentially eliminate the need to permanently install pipelines, liquid-gas separators, dehydrators and related equipment at the well-head.

Other objects and many of the advantages of the present invention will become readily apparent from the following Description of the Preferred Embodiment, when taken together with the accompanying drawings.

DESCRIPTION OF THE PREFERRED EMBODIMENTS

Figure 1:
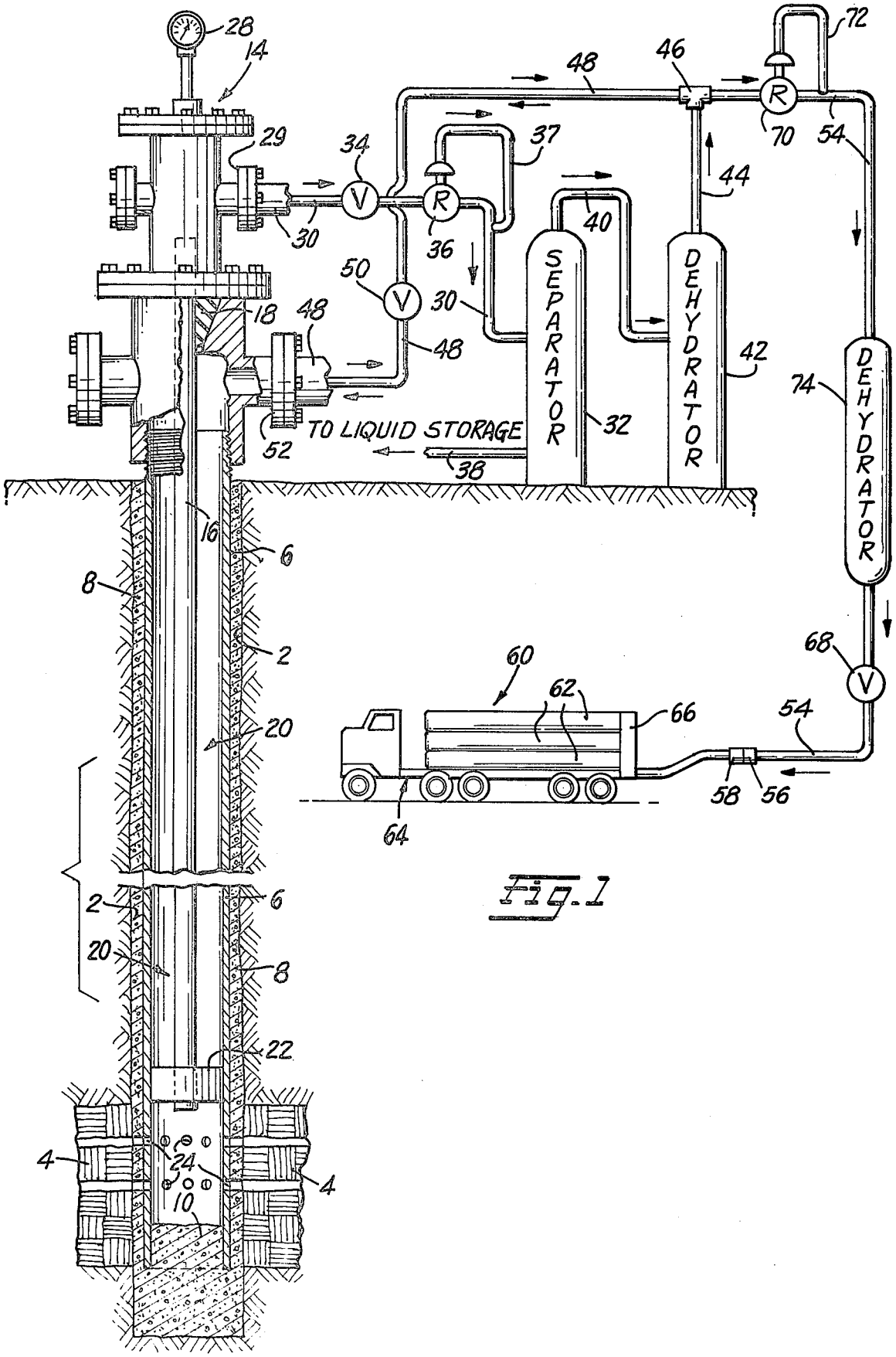
FIG. 1 is a diagrammatic view, partly in section, of the apparatus of the preferred embodiment of the invention, and shows a typical tight formation gas well having an annular reservoir, gas treatment equipment, and a conduit arrangement for transferring accumulated natural gas to a mobile pressure vessel unit.

Referring now to FIG. 1, a typical deep well bore in a tight formation area is indicated at 2, the lower end of the bore penetrating into a gas producing geological strata 4. After drilling, the bore 2 is completed by inserting outer casing tubing 6 thereinto, about which cement or grout 8 is placed to position it and to effect sealing between different vertical geological formations. The lower end of the casing tubing 6 is embedded in a body of cement or grout 10, which is a part of the cement or grout 8.

The upper end of the outer casing tubing 6 carries the lowermost element 12 of a Christmas tree 14 thereon, and suspended from the Christmas tree is the inner production tubing 16. Typically, the Christmas tree 14 will include a wedge arrangement 18 for sealing the upper end of the annular chamber 20 defined between the production and casing tubings 6 and 16, and the lower end of this annular chamber is sealed by a conventional lower end annular packer or plug 22. The vertical region of the outer casing tubing 6 between the packer 22 and the body of cement 10 has perforations 24 in its wall, the perforations also extending through the encasing cement or grout and providing channels for natural gas to flow into the outer casing region from the geological strata 4. The natural gas then enters the lower end of the production tubing 16, and flows upwardly to the Christmas tree 14.

A gas well in a tight formation area is usually quite deep, perhaps 8,000 to 12,000 feet. It is to be understood that FIG. 1 is drawn diagramatically, and not to scale. Typically, in an actual well, the outer diameter of the casing tubing 6 might be about 7 inches, and its inner diameter about 6.25 inches. Further, the inner production tubing 16 typically might have outer and inner diameters of about 2.875 and 2.151 inches, respectively. For a very deep well, the bore 2 might be about 2 to 3 feet in diameter near the top, and only a few inches in diameter at the bottom. Further, while only a single outer casing tubing 6 is shown in FIG. 1, it is to be understood that in practice there can be several such casings, with the one of largest diameter being at the top. However, in such instances the annular chamber 20 will still be present, sealed according to the invention at both its upper and its lower ends.

In the preferred embodiment of FIG. 1, the annular chamber 20 between the production and casing tubings 6 and 16 constitutes an annular reservoir, utilized to accumulate natural gas produced by the geological strata 4 through the production tubing 16 and the Christmas tree 14. The Christmas tree includes an intermediate element 26, capped by a pressure gauge 28. The upper end of the production tubing 16 is in communication with the intermediate Christmas tree element 26, and the latter is provided with an outlet fitting 29 to which a conduit 30 is connected that leads to the inlet of a conventional liquid-gas separator unit 32. A flow-control valve 34 is connected in the conduit 30, followed by a pressure regulator 36 that includes a tap line 37 connected to the conduit 30 downstream of the regulator. Thus, when the flow-control valve 34 is opened, natural gas flows into the liquid-gas separator 32, which functions to separate the natural gas from associated liquids, the latter being drained off through a discharge conduit 38 to a liquid storage vessel or elsewhere.

The outlet of the liquid-gas separator 32 is connected to one end of a conduit 40, which leads to the inlet of a conventional gas dehydrator unit 42 designed to be effective for removing water from the natural gas and rendering it sufficiently dry for safe transport and handling. A conduit 44 connects the outlet of the dehydrator unit 42 to the center leg of a branch fitting 46, one branch of which is connected by a conduit 48 through a flow-control valve 50 to an inlet fitting 52 carried by the lowermost Christmas tree element 12. The conduit 48 will thus supply natural gas to the annular chamber or reservoir 20, when the flow-control valves 34 and 50 are in an open condition. Further, the natural gas supplied to the annular reservoir 20 is treated by the units 32 and 42, and is ready for transport.

The other branch of the fitting 46 has a loading conduit 54 connected thereto, which leads to a connector element 56 designed to be detachably connected with a mating connector element 58 provided on the manifold of a mobile pressure vessel unit 60. The pressure vessel unit 60 in FIG. 1 is similar to the units described in the two United States patents identified earlier, and includes pressure vessels 62 mounted on a semi-trailer truck 64 and provided with a manifold arrangement 66 to assure safe handling of the natural gas. Flow through the loading conduit 54 is controlled by a loading flow-control valve 68, and an upstream pressure regulator 70 regulates the pressure of the natural gas. The pressure regulator 70 includes a pressure tap line 72, connected downstream thereof. A gas dehydrator unit 74 is also included in the loading conduit 54 of FIG. 1, to effect any required final removal of moisture from the natural gas.

The safe handling of natural gas in high strength steel pressure vessels requires that the moisture content in the natural gas be kept at or below a specific value, as is explained in our earlier identified prior patents. The final gas dehydrator unit 74 is utilized in FIG. 1 to assure that this condition for safe natural gas handling is achieved. If the natural gas is sufficiently dry so that the dehydrator unit 74 is clearly not required, then the unit 74 can either be deactivated or removed from the system.

In using the apparatus of FIG. 1 to practice the present method, natural gas from the geological strata 4 is collected in the annular reservoir 20, the flow-control valve 34 and 50 being open during this lapse of time, and the loading flow-control valve 68 being closed. After a desired quantity of natural gas at a selected pressure has accumulated in the reservoir 20, the flow-control valve 34 is closed. The mobile pressure vessel unit 60 is then connected by joining the connector elements 56 and 58, and the flow-control valve 68 is opened. Natural gas then flows out of the annular reservoir 20 through the open flow-control valve 50, the conduit 48, the loading conduit 54 and the dehydrator unit 74, the pressure regulator 70 functioning to assure that the pressure vessels 62 are not overloaded. After loading of the unit 60 is complete, the loading flow-control valve 68 is closed, and the connector elements 56 and 58 are uncoupled. The mobile pressure vessel unit 60 is then driven to another well if not full, or to an off-loading facility (not shown) for emptying.

The typical operating pressure for pressure vessel units like those employed in our earlier identified U.S. patents is in the 2,000 to 3,000 psi range, with an average of about 2,200 to 2,500 psi. To assure proper loading of the natural gas, it is thus desirable to allow natural gas to build up in the annular reservoir 20 until a reservoir pressure somewhat in excess of this 2,500 psi pressure vessel operating pressure is achieved, perhaps about 2,700 psi or in the case of a deep well in the 10,000 foot range considerably greater than this value. The time required for this to occur will vary from well to well, and can be from several hours to a week or more. Once the reservoir pressure has reached an acceptable level, it is desirable to remove the natural gas from the reservoir 20, and the collection schedule should be chosen to assure such timely collection. If collection does not then occur, the optimum production of natural gas cannot usually be achieved from the well. This is true because the presence of high pressures in the reservoir at the upper end of the well will inhibit the movement of more natural gas from the geological strata 4, movement which will eventually cease when well pressures equalize sufficiently.

For the present invention to properly function, the tight formation wells selected for this application should be capable of producing pressures at least in the 2,000 to 3,000 psi range. Otherwise, on-site compression equipment may be required for natural gas loading, which tends to lessen the economic effectiveness of the invention. Fortunately, as described earlier, there are many tight formation wells that can produce pressures in the required range and considerably beyond. If the natural gas production pressure in a given well does not rise much above the 2,500 psi level, then it may be possible to omit the pressure regulators 36 and 70 from the system. Normally, however, the presence of these two regulators is preferable, even if they are not essential, so as to handle any sudden pressure surge.

Depending upon the quality of the natural gas produced from the geological strata 4, the liquid-gas separator 32 or the gas dehydrator unit 42, or both, may not be required in the system of FIG. 1. Usually, however, it is desirable to employ at least one of the two dehydrator units 42 and 74, to be certain that the natural gas to be transported has a water content within safe limits.

The invention contemplates that the gas dehydrator unit 42 might be eliminated, in which instance the conduits 40 and 44 would be directly coupled. Further, with this arrangement it is also contemplated that the gas dehydrator unit 74 might be made portable, and would from well-head to well-head as the pressure vessel units 60 make their rounds.

In some instances, the annular packer or plug 22 may not be fully effective, or it may deteriorate over time. When this occurs, natural gas may flow into the annular chamber 20 from the bottom, a condition that can also occur if the outer casing tubing 6 is not sealed over its length. Under these circumstances the natural gas stored in the annular chamber 20 may receive moisture, in which case the gas dehydrator unit 42 may not be fully effective. Especially under these conditions, the gas dehydrator unit 42 can be eliminated from the apparatus, and the dehydrator unit 74 utilized to effect all moisture removal.

In some instances, it may be desirable to utilize both the annular chamber 20 and the interior of the production tubing 16 for natural gas storage at the well site, or even to rely on the tubing 16 alone. The system of FIG. 1 can be utilized to achieve either of these results.

To utilize both the annular chamber 20 and the interior of the production tubing 16 as reservoirs, natural gas is supplied to the annular reservoir 20 until it has reached the desired operating pressure, approximately 2,700 psi. Flow to the reservoir 20 can then be terminated, either by closing the flow-control valve 50, or by selecting a pressure regulator 36 that will close at the selected pressure. Thereafter, pressure will continue to accumulate in the production tubing 16.

When the time for emptying the accumulated natural gas into the mobile pressure vessel unit 60 occurs, the loading flow-control valve 68 is opened after the connector elements 56 and 58 are coupled. Natural gas will then flow from the production tubing 16 through the liquid-gas separator unit 32 and the gas dehydrator unit 42. Usually, it is desirable to have the valve 50 closed during this flow, so that only natural gas from the production tubing 16 enters the unit 60 initially. When the production tubing 16 has been emptied, the valve 50 is opened to feed the natural gas from the annular reservoir 20. If desired, one-way check valves can be inserted into the system, to assure that natural gas from the reservoir 20 does not flow back through the dehydrator unit 42. Typically, the volume of natural gas available from the production tubing 16 will be a fraction of that contained in the annular reservoir 20.

If it should be desired to operate the apparatus of FIG. 1 using only the reservoir capacity of the production tubing 16, this is easily achieved simply by closing the flow-control valve 50 and keeping it closed.

Figure 2:
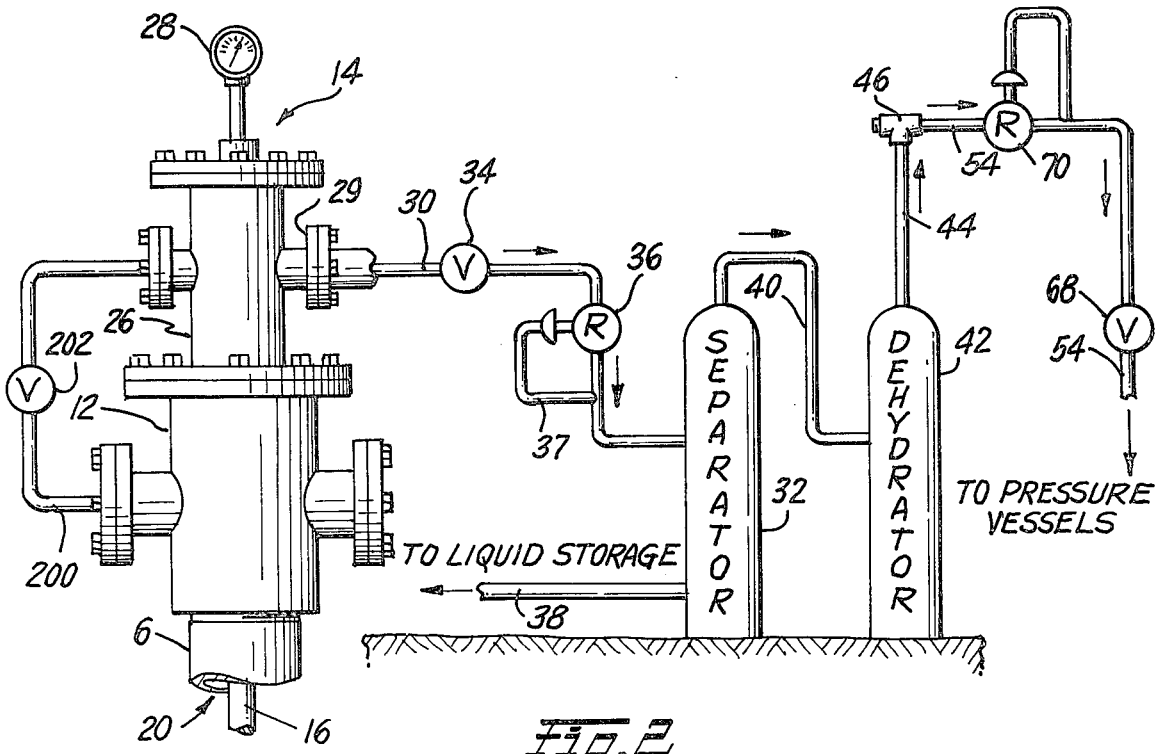
FIG. 2 is a modified form of the apparatus of the invention, wherein the production tubing provides the only storage reservoir.

For those wells where operation on the reservoir storage capacity of the production tubing 16 is adequate, the system components of FIG. 1 utilized with the annular reservoir 20 can be eliminated. Such an arrangement is shown in FIG. 2, wherein elements identical to those in FIG. 1 carry like numbers. Both FIG. 1 and FIG. 2 show the pressure regulator 36, which should be utilized when well pressures exceed about 3,000 psi or so. When the well pressure is significantly below this value, the pressure regulators 36 and 70 could both be left out of the system, if desired; however, as noted earlier, their presence is preferred for reasons of safety in the event of sudden pressure surges.

It will also be noted that the final gas dehydrator unit 74 has been eliminated in FIG. 2, as not necessary in light of the dehydrator unit 42 through which all natural gas must pass on its flow to the loading conduit 54. Again, it may be possible to deactivate or eliminate either or both of the separator and dehydrator units 32 and 42 in FIG. 2, if the natural gas from the well is of sufficient quality that these units are not necessary.

The present invention also contemplates that it may be desirable to make both the liquid-gas separator unit 32 and the gas dehydrator unit 42 portable, whereby they could be moved from well-head to well-head with the pressure vessel units 60. This can be easily accomplished with the arrangement of FIG. 2.

Referring to FIG. 2, the liquid-gas separator unit 32, the dehydrator unit 42, and the two pressure regulators 36 and 70 could be mounted on a trailer or the like, the flow-control valves 34 and 68 being utilized to connect the units to the well-head and the pressure vessel unit 60, respectively. The flow-control valve 34 is then opened only when the separator and dehydrator units 32 and 42 are in place and are connected to a pressure vessel unit 60. When emptying of the well storage is completed, the flow-control valve 34 of FIG. 2 is closed, and the separator and dehydrator units 32 and 42 can then be disconnected and moved to the next well-head. The economic advantages of this concept can be great, if the nature of the gas wells being serviced lend themselves to the technique.

Turning again to FIG. 2, the arrangement shown therein can also be utilized together with the annular reservoir chamber 20. For this purpose, a conduit 200 is connected between the intermediate element 26 and the lowermost element 12 of the Christmas tree 14, and has a flow-control valve 202 connected therein. When the valve 202 is open, natural gas can flow from the production tubing 16 into the annular reservoir 20, and during loading of a pressure vessel unit 60 from the annular reservoir 20 through the intermediate element 26 to the conduit 30. When it is not desired to utilize the annular reservoir chamber 20, the flow-control valve 202 is simply closed.

Figure 3:
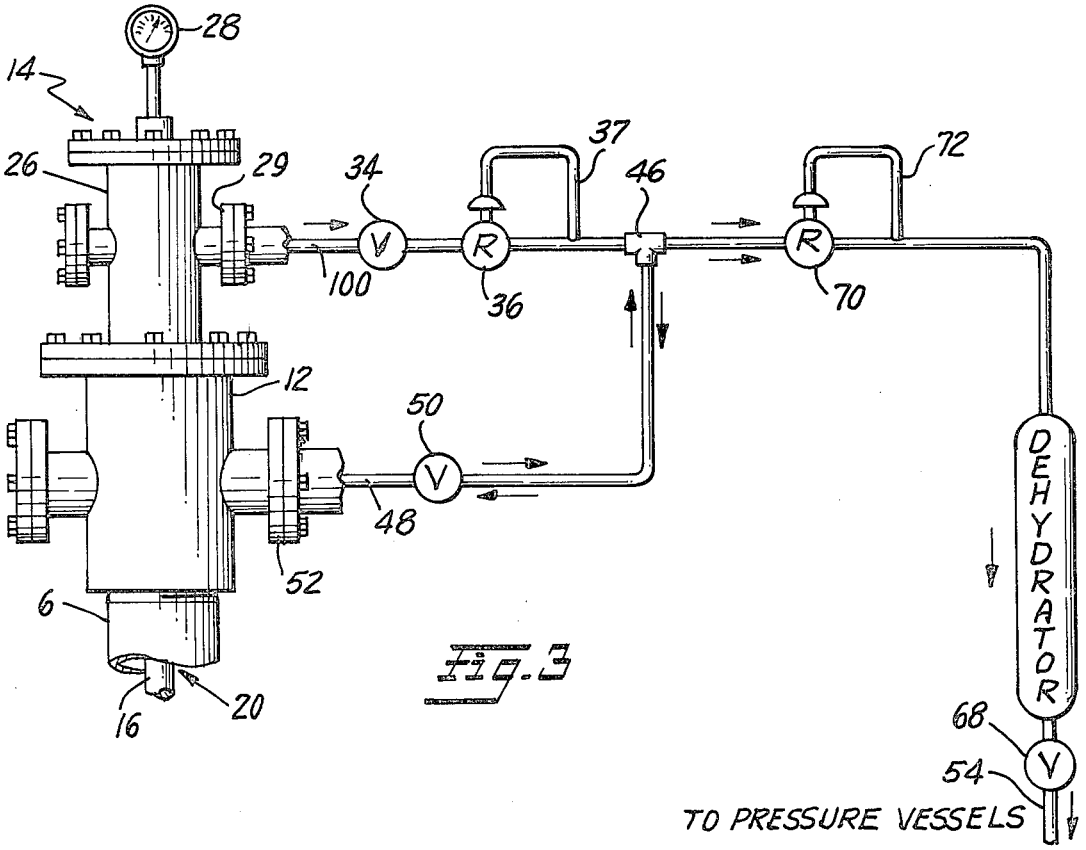
FIG. 3 is another modification of the apparatus of the invention, wherein both the production tubing and the annular reservoir function as reservoirs for accumulating natural gas.

In those instances where pretreatment of the natural gas is not required, it is also possible to utilize both the annular reservoir 20 and the production tubing 16 as a combined reservoir in a simplified arrangement of components. An embodiment of the invention employing this concept is shown in FIG. 3, where again components identical to those in FIG. 1 carry the same reference numbers. Referring to FIG. 3, the liquid-gas separator unit 32 and the natural gas dehydrator unit 42 of FIG. 1 are both omitted, and a conduit 100 in which the flow-control valve 34 and the pressure regulator 35 are connected leads directly to one leg of the branch fitting 46. A second conduit 102 connects the center leg of the branch fitting 46 directly with the inlet 52 on the Christmas tree element 12, through the control valve 50.

The embodiment of FIG. 3 is utilized in a manner similar to the embodiments of FIGS. 1 and 2, to carry out the method of the invention. Natural gas rising through the production tubing 16 flows through the conduit 100 and the conduit 102 into the annular reservoir 20, where it accumulates. The loading flow-control valve 68 is of course closed at this time, and the valves 34 and 50 open. The pressure regulator 36 functions to control the pressure supplied to the annular reservoir 20, and later to the loading conduit 54. Natural gas under pressure will accumulate in both the production tubing 16 and the annular reservoir 20, and when the desired optimum batch volume of natural gas has accumulated a mobile pressure vessel unit will be connected to the loading conduit 54 and the loading flow-control valve 68 will be opened.

The natural gas will then flow through the loading conduit 54 from both the annular reservoir 20 and the production tubing 16, the pressure regulator 70 controlling the pressure of the flowing natural gas. The dehydrator 74 is again employed in FIG. 3, to assure that the natural gas reaching the pressure vessel unit is sufficiently free of water. When the unit is filled or the reservoirs are emptied, whichever first occurs, the flow-control valve 68 is closed, and natural gas is again accumulated in the connected reservoirs formed by the annular space 20 and the production tubing 16. Again, if the natural gas pressure is sufficiently low, the two regulators 36 and 70 could be eliminated from the system, if desired.

Turning now in more detail to the method of the invention, it is believed that such should have become clear from the preceding description of the apparatus and how it functions. The method includes the following steps:

1. First, the well bore is completed with suitable piping, designed and arranged to define a sealed reservoir for receiving and accumulating natural gas produced from the tight formation. The upper end of the reservoir is connected by suitable means with a conduit system for connecting it to a mobile pressure vessel unit, and other well equipment as described with respect to FIGS. 1 through 3 is installed to accommodate the quality of the natural gas and the desired manner of utilizing the reservoir storage.
2. Calculations are made for each well of the rate of natural gas flow from the tight formation into the well's reservoir, the holding capacity of the reservoir, and the time lapse required to accumulate a batch volume of natural gas within the reservoir having a volume and pressure chosen to assure optimum well production.

There are several known methods for calculating the rate of natural gas production from a geological strata, and a suitable method would be known to the engineer who is responsible for the natural gas production. The holding capacity of the reservoir can be mathematically determined, and from knowing the production rate and pressure of the natural gas it is then a simple matter to determine an assumed length of time that will be required to accumulate a desired batch volume or quantity of natural gas. This assumption is tested during actual gas production from the well, and is adjusted to the extent necessary based on empirical evidence. As noted earlier, the desired batch or quantity of natural gas should be optimized relative to the productive capacity of the well, so that a pickup time for the accumulated natural gas is identified to assure timely removal of the batch before the pressure thereof inhibits production.

With these calculations made, the next step of the method is as follows:

3. The optimum batch volumes for the wells being utilized are analyzed, and a determination is made of the number of mobile pressure vessel units required, using simple mathematical relationships.

The capacity and operating pressures for the pressure vessel units will be known, and from this information the number of units required to hold the volume of natural gas that will accumulate to provide optimum batch volumes or quantities in each well can be calculated. The amount of time required for each well to produce an optimum batch of natural gas will indicate how many pressure vessel units a given well will require over a period of time. With this information in hand, the next step of the method is carried out:

4. A collection schedule is established for servicing each of the wells, the schedule being designed to remove optimum batch volumes of natural gas from the reservoirs in a timely manner.

The techniques for establishing a schedule are known. Once established, the collection schedule should assure substantially continuous natural gas production from the selected wells. The remaining steps of the method are as follows:

5. Moving the mobile pressure vessel unit to each well in accordance with the collection schedule, temporarily connecting it to the well's reservoir with the connector means of the apparatus, and transferring the optimum batch volume of natural gas from the reservoir to the unit.
6. Moving the pressure vessel unit to an off-loading facility periodically in accordance with the collection schedule, and substantially emptying it at the facility.
7. Repeatedly moving the mobile pressure vessel unit between the gas wells and the off-loading facility in accordance with the collection schedule, to effect optimum continuous natural gas production.

The reservoir arrangement utilized with the method of the invention can be either the production tubing 16, the annular reservoir 20, or a combination of these, as described earlier. Further, the method can also include the steps of passing the natural gas through the liquid-gas separator unit and the gas dehydrator unit, as described earlier, and indeed this will normally occur when practicing the method unless the natural gas is of unusually high quality. In addition, the loading step can, and preferably will, include the step of passing the natural gas through a gas dehydrator as it is being loaded into the pressure vessel unit.

The method can be adapted to the different operating modes of the apparatus, as described earlier, relating to the different conduit arrangements of FIGS. 1 through 3, and to the presence or absence of the liquid-gas separator and the gas dehydrator units. Finally, the method can also include passing the natural gas through pressure regulators both at the outlet from the production tubing, and in the loading conduit leading to the pressure vessel unit. As noted earlier, the use of such pressure regulators is normal when the pressure of the natural gas in the well is considerably in excess of the desired operating pressure for the pressure vessel unit. The method can be employed on a single gas well, or on all the suitable wells in a natural gas field.

It will be understood that actual natural gas production may not always occur as calculated. Thus, the gas wells need to be monitored, using the pressure gauge 28 and other equipment and measurements, and necessary adjustments to the collection schedule made. The techniques for doing this are well known.

It will also be understood that gas wells can have different configurations, and that FIGS. 1 through 3 are exemplary only. For example, it is not uncommon for a single well-head to contain a plurality of production tubes 16, fitted to a suitably designed Christmas tree. The different production tubes 16 may lead to various producing strata, or they may extend to the same strata. The method and apparatus of the invention are readily adaptable to all of these variations.

In order to provide a better understanding of the method, the following is characteristic data for a typical tight formation gas well:

EXAMPLE

| | |
|---|---|
| Total well bore depth | 12,000 feet |
| Casing tubing outside diameter | 7.00 in. |
| Casing tubing inside diameter | 6.25 in. |
| Production tubing outside diameter | 2.875 in. |

-continued

| | |
|---|---|
| Production tubing inside diameter | 2.151 in. |
| Volume in production tubing | 302 cubic feet |
| Volume in annular reservoir | 2,015.65 cubic feet |
| Well production rate | 150 mscf per day |
| Well gas formation pressure | 4,800 psi |
| Gas contained in production tubing | 98.99 mscf (at 4,800 psi) |
| Gas contained in annular reservoir | 658.17 mscf (at 4,800 psi) |
| Pressure vessel unit volume | 776 cubic feet |
| Pressure vessel unit working pressure | 2,400 psi |
| Pressure vessel unit discharge pressure | 200 psi |
| Pressure vessel unit net volume of gas hauled | 143.8 mscf per load (at 2,400 psi) |

For this example, it is obvious that the pressure regulator 70 should be utilized, to prevent overloading of the pressure vessel unit. Further, in the preferred embodiment of FIG. 1, the pressure regulator 36 should also be utilized, so that the pressure that is allowed to accumulate in the annular reservoir does not exceed the pressure vessel unit working pressure by more than a few hundred psi, at most. This will provide for optimum safe handling of the natural gas.

Given that in this example the gas well can produce 150 mscf, or million standard cubic feet, of natural gas in a 24-hour period, and assuming a 143.8 mscf carrying capacity for the pressure vessel unit, the unit should visit and service the well every 24 hours, or once a day.

Because of the high gas formation pressure of the gas well in the example, the production tubing employed can contain nearly 100 mscf of natural gas. Thus, its use as an auxiliary reservoir is practical, and it could also be utilized as the only reservoir. In the latter instance, however, emptying the production tubing into the pressure vessel unit would not fill the unit, and thus another well would need to be serviced to obtain maximum operating efficiency from the method.

It is believed that this example will provide a thorough understanding of the present method, and demonstrate how the described embodiments of the apparatus function to enable the method to be practiced. The present invention provides a practical system for producing tight formation natural gas wells, and avoids the very large and not always successful bottom-of-the-well techniques now being developed and employed. But at the same time, the method would be useable with tight formation gas wells that have been treated to improve their gas flow characteristics, and indeed with nearly any natural gas wells.

It will be seen that the method and apparatus as described carry out the purposes identified earlier for the invention. Obviously, modifications and variations other than those described herein are possible, without departing from the teachings presented or the scope of the annexed claims.

We claim:

1. The method for producing natural gas from a preselected number of gas wells located in a tight formation producing area, including the steps of:

equipping each of said wells with piping means designed and arranged to define a sealed reservoir for receiving and accumulating natural gas produced from said tight formation area over a lapse of time, the piping means for each of said wells including an inner production tubing having a casing tubing placed thereabout in annular spaced relationship, the upper and lower ends of the annular chamber formed between said production tubing and said casing tubing being closed and said annular chamber forming at least part of said sealed reservoir, the annular chamber being connected with said production tubing by conduit means having a flow control valve therein operable to control natural gas flow into said chamber, and the upper end of said piping means being fitted with connector means communicating with said annular chamber and adapted for detachably connecting said reservoir with mobile pressure vessel means;

calculating for each of said wells the rate of natural gas flow from said tight formation area into said reservoir, the holding capacity of said reservoir, and the time lapse required to accumulate a batch of natural gas within said reservoir having a volume chosen to assure optimum well production;

calculating the number of mobile pressure vessel means required to assure collection of each optimum batch volume in a timely manner;

establishing a collection schedule for servicing each of said wells, designed to remove optimum batch volumes of natural gas from the reservoir thereof in a timely manner;

opening said flow control valves to produce said natural gas wells and cause the accumulation of natural gas within said reservoirs in accordance with said well calculations;

moving a mobile pressure vessel means to each well in accordance with said collection schedule, temporarily connecting it to the well's reservoir with said connector means, and transferring said optimum batch volume of natural gas to said pressure vessel means;

moving all of said pressure vessel means to an off-loading facility periodically in accordance with said collection schedule, and substantially emptying said pressure vessel means at said facility; and repeatedly moving said mobile pressure vessel means between said gas wells and said off-loading facility in accordance with said collection schedule and with said flow control valves operated to produce said wells, to effect optimum continuous natural gas production from said tight formation producing areas.

2. The method for producing natural gas as recited in claim 1, wherein natural gas is passed through liquid-gas separator means located in said conduit means before entering said annular chamber, in each of said wells.

3. The method for producing natural gas as recited in claim 1, wherein natural gas is passed through gas dehydrator means located in said conduit means before entering said annular chamber, in each of said wells.

4. The method for producing natural gas as recited in claim 1, wherein natural gas is passed through gas dehydrator means and liquid-gas separator means in each of said wells before entering said annular chamber, said gas dehydrator means and said liquid-gas separator means being located in said conduit means.

5. The method for producing natural gas as recited in claim 1, wherein said step of transferring said optimum batch volume of natural gas from said reservoir to said pressure vessel means includes passing the natural gas through dehydrator means for removing moisture therefrom, whereby to assure that the moisture level of the natural gas will be within the value required to assure safety of the pressure vessel means.

6. The method for producing natural gas as recited in claim 1, including the further step of passing the natural gas through liquid-gas separator means before it is transferred to said pressure vessel means.

7. The method for producing natural gas as recited in claim 1, wherein said step of transferring said optimum batch volume of natural gas from said reservoir to said pressure vessel means includes regulating the pressure of said natural gas, to assure that said pressure vessel means is not overfilled.

8. Apparatus for producing natural gas from a preselected number of gas wells located in a tight formation producing area, including:

piping means installed in each of said wells, designed and arranged to define a reservoir for receiving and accumulating over a lapse of time natural gas produced from said tight formation area, said piping means including:

an outer casing tubing mounted within the well bore;

an inner production tubing mounted concentrically within said outer casing tubing in spaced relationship, and defining therewith an annular reservoir chamber for containing natural gas;

seal means closing the upper and lower end portions of said annular chamber; and conduit means connecting said inner production tubing with said annular chamber;

connector means on the upper end of said piping means, said connector means being connected to receive natural gas from said annular chamber; and mobile pressure vessel means, the number of said pressure vessel means being selected in accordance with a collection schedule established for servicing said wells in a manner to assure the timely removal of optimum batch volumes of natural gas from said reservoirs, and each pressure vessel means being connectable with each reservoir by said connector means.

9. Apparatus for producing natural gas as recited in claim 8, including additionally:

liquid-gas separator means connected so that natural gas from said gas well passes therethrough before entering said mobile pressure vessel means.

10. Apparatus for producing natural gas as recited in claim 9, wherein said liquid-gas separator means is located in said connecting means, for treating natural gas moving from said production tubing into said annular reservoir chamber.

11. Apparatus for producing natural gas as recited in claim 10, including additionally:

gas dehydrator means located in said connecting means, for treating natural gas moving from said production tubing into said annular reservoir chamber.

12. Apparatus for producing natural gas as recited in claim 8, including additionally:

dehydrator means located between said connector means and said pressure vessel means, arranged and designed to remove moisture from natural gas passing therethrough to assure that the moisture level of natural gas entering said pressure vessel means will be within the value required to assure the safety thereof.

13. Apparatus for producing natural gas as recited in claim 8, including additionally:

pressure regulator means mounted in said connector means, to regulate the pressure of the natural gas flowing into said pressure vessel means.

14. Apparatus for producing natural gas as recited in claim 12, including additionally:

pressure regulator means mounted on the outlet of the production tubing, to control the pressure of natural gas as it comes from the formation and before it enters the annular reservoir chamber.

15. Apparatus for producing natural gas as recited in claim 8, including additionally:

pressure regulator means mounted in said conduit means, for controlling the pressure of natural gas supplied to said annular reservoir chamber.

16. Apparatus for producing natural gas as recited in claim 8, wherein said production tubing and said annular reservoir chamber are in communication, and function together to provide a reservoir for natural gas acculation.

17. Apparatus for producing natural gas as recited in claim 8, including additionally:

pressure regulator means connected in said connector means, and arranged to control the pressure of natural gas supplied from said production tubing.

18. Apparatus for producing natural gas as recited in claim 17, including additionally:

gas dehydrator means and liquid-gas separator means connected in said connector means, after said pressure regulator means.

* * * * *